United States Patent [19]

Rudszinat

[11] Patent Number: 4,478,231

[45] Date of Patent: Oct. 23, 1984

[54] APPARATUS FOR SEVERING CIGARETTE RODS OR THE LIKE

[75] Inventor: Willy Rudszinat, Dassendorf, Fed. Rep. of Germany

[73] Assignee: Hauni-Werke Körber & Co. KG., Hamburg, Fed. Rep. of Germany

[21] Appl. No.: 279,567

[22] Filed: Jul. 1, 1981

[30] Foreign Application Priority Data

Jul. 9, 1980 [DE] Fed. Rep. of Germany ..... 3025968

[51] Int. Cl.[3] ..... A24B 5/28

[52] U.S. Cl. ..... 131/84 C; 83/926 H

[58] Field of Search ..... 131/83 R, 84 C, 280; 145/31 R; 56/12.7; 83/926 H

[56] References Cited

U.S. PATENT DOCUMENTS 3,826,068 7/1974 Ballas et al. ..... 56/12.7

FOREIGN PATENT DOCUMENTS 0197807 7/1978 Fed. Rep. of Germany ..... 56/12.7

*Primary Examiner*—Vincent Millin

*Attorney, Agent, or Firm*—Peter K. Kontler

[57] ABSTRACT

A cutoff for cigarette rods or the like has a rotary carrier for one or more reels of convoluted metallic band material constituting the knife or knives which sever the rod at regular intervals when the carrier rotates. The reels can be rotated in a direction to pay out the band material, and the leaders of the bands extend from the carrier and orbit along a path which is traversed by the rod. The leaders are ground at the rate at which the reels are rotated so that the length of that portion of each band which extends from the carrier remains constant. One marginal portion of each band constitutes the cutting edge, and such cutting edges need not be sharpened while the cutoff is in use because rotation of the reels results in movement of fresh portions of cutting edges to severing positions. The leaders of the bands are caused to extend through adjustable chucks with cheeks flanking the leaders to reduce the likelihood of undesirable deformation of flexible leaders during severing of the rod and/or in response to rotation of the carrier at a high speed.

20 Claims, 5 Drawing Figures

APPARATUS FOR SEVERING CIGARETTE RODS OR THE LIKE

BACKGROUND OF THE INVENTION

The present invention relates to apparatus for severing cigarette rods or the like. More particularly, the invention relates to improvements in apparatus, known as cutoffs, which are utilized for repeated severing of axially conveyed rods consisting of wrapped tobacco or filter material.

It is known to sever a continuous axially conveyed cigarette rod by resorting to a cutoff wherein a rotary carrier supports one or more knives each of which severs the rod during each revolution of the carrier and each of which is sharpened, either during each revolution of the carrier or at predetermined intervals. The rod thereby yields plain cigarettes of unit length or multiple unit length. Similar apparatus are utilized for the severing of a continuous filter rod which is to be subdivided into filter rod sections of desired length, e.g., of six or eight times unit length, depending upon the nature of the tipping machine wherein the filter rod sections are united with plain cigarettes, cigars or cigarillos to form filter cigarettes, cigars or cigarillos of unit length or multiple unit length. Such apparatus are further provided with means for advancing or feeding the knife or knives at required intervals or continuously so as to compensate for wear which develops as a result of severing as well as in response to sharpening of each knife. Still further, a conventional cutoff normally comprises a guide which supports the axially conveyed rod at the severing station and moves with the rod while the rod is being severed to yield sections of desired length. Such guide is or can be employed irrespective of whether the cutoff is used in a cigarette making or in a filter rod making machine. Cigarette making machines which utilize cutoffs of the above outlined character are known as Garant and SE 80, both produced by the assignee of the present application. A filter rod making machine which embodies a similar cutoff is known as KDF and is also produced by the assignee of the present application.

A drawback of heretofore known cutoffs is that the knife or knives must be replaced at frequent intervals. Thus, the dimensions of the knife or knives in a conventional cutoff are such that the wear thereupon rapidly reaches a stage at which the knife cannot be fed any longer and cannot be subjected to further grinding action because the stroke of the feeding mechanism for the knife is exhausted. This means that the machine must be arrested for the express purpose of replacing one or more spent knives with fresh knives. Since a cigarette making or filter rod making machine can turn out in excess of 100 cigarettes or filter rod sections per second, any stoppage entails pronounced losses in output. On the other hand, the wear upon the knives in a machine which operates at such a high speed is very pronounced so that the replacement of conventional knives at frequent intervals is unavoidable.

OBJECTS AND SUMMARY OF THE INVENTION

An object of the invention is to provide a novel and improved severing apparatus wherein the useful life of the knife or knives is longer than in heretofore known apparatus.

Another object of the invention is to provide a severing apparatus wherein the knife or knives can be replaced with little loss in time and without resort to complex or expensive tools.

A further object of the invention is to provide a cigarette rod making or filter rod making machine with a novel and improved cutoff.

An additional object of the invention is to provide the cutoff with novel and improved means for severing a continuously moving rod of wrapped tobacco or filter material.

Still another object of the invention is to provide a cutoff whose knife or knives need not be sharpened when the cutoff is in use.

An additional object of the invention is to provide novel and improved knives for use in a cutoff for continuous rods containing tobacco, substitute tobacco or filter material.

Still another object of the invention is to provide a cutoff which is more suited for severing at frequent intervals than heretofore known severing apparatus for filter rods, cigarette rods or the like.

An ancillary object of the invention is to provide the cutoff with novel and improved means for guiding the knife or knives in the region where the cutting edge or edges of the knife or knives sever an axially conveyed rod of tobacco or filter material.

A further object of the invention is to provide a compact cutoff which can be installed in existing filter rod making or cigarette making machines as a superior substitute for conventional cutoffs.

Another object of the invention is to provide the cutoff with novel and improved means for rapidly changing the orientation of the cutting edge of each knife with reference to the axis of the commodity to be severed.

One feature of the invention resides in the provision of an apparatus for subdividing a rod that contains a filler of fibrous material (such as tobacco, substitute tobacco or filamentary filter material) into discrete rod-like sections (e.g., into plain cigarettes, cigars or cigarillos or filter rod sections). The apparatus comprises a preferably hollow carrier which is rotatable about at least one predetermined axis, and at least one elongated flexible band-like knife including a convoluted portion constituting or resembling a reel which is supported by the carrier as well as a leader which extends from the convoluted portion and is arranged to sever the rod in response to rotation of the carrier. If the carrier is hollow, the convoluted portion is preferably installed in its interior and the carrier has an opening through which the leader extends outwardly. The convoluted portion is preferably removably mounted in or on the carrier, e.g., on a shaft whose axis is parallel with or inclined (e.g., at right angles) with reference to the axis of rotation of the carrier.

The knife has an elongated marginal portion which constitutes or may constitute a cutting edge. That part of the cutting edge which is provided on the leader serves to sever the rod in response to rotation of the carrier. The apparatus then further comprises a planetary transmission or other suitable feeding means which rotates the convoluted portion of the knife in a direction to unwind the knife and to thereby advance fresh parts of the cutting edge through and beyond the opening of the carrier. Still further, the apparatus may comprise a rotary grinding tool or analogous means for removing material from the leader at the rate at which the feeding means rotates the convoluted portion; this ensures that the length of the leader remains constant. For example, the grinding tool can engage the front edge face of the leader to remove material from the leader whenever the convoluted portion is rotated in a direction to pay out the material of the flexible knife.

The apparatus preferably further comprises a chuck which is installed in the aforementioned opening of the carrier and has a slot through which the leader of the knife extends outwardly. The chuck is preferably adjustable with reference to the carrier, and the latter may be provided with or it may cooperate with detent means for releasably holding the chuck in a selected position of adjustment with reference to the carrier. For example, the chuck may be mounted for angular movement about an axis which is inclined (e.g., at least substantially at right angles) with reference to the axis of rotation of the carrier.

The chuck may be provided with one or more cheeks or otherwise configurated protuberances adjacent to the slot, e.g., with a pair of cheeks which flank the slot at that side of the chuck that faces away from the interior of the carrier. The cheeks can stiffen the leader of the knife immediately adjacent to the region where the cutting edge of the leader severs the rod in response to each revolution of the carrier.

If the axis of the reel constituting the convoluted portion of the knife is parallel or nearly parallel to the axis of rotation of the carrier, the knife is normally at least slightly twisted in the region between the convoluted portion and the chuck. Such twisting can be avoided, or its extent reduced, if the axis of the reel is normal to the axis of rotation of the carrier.

The knife is or may constitute a metallic band of constant width. If the apparatus comprises two or more knives, each such knife constitutes a discrete metallic band having a convoluted portion in the interior of the carrier and a leader which extends through an opening of and from the carrier. The leaders of successive knives then sever the rod seriatim in response to rotation of the carrier.

The novel features which are considered as characteristic of the invention are set forth in particular in the appended claims. The improved severing apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
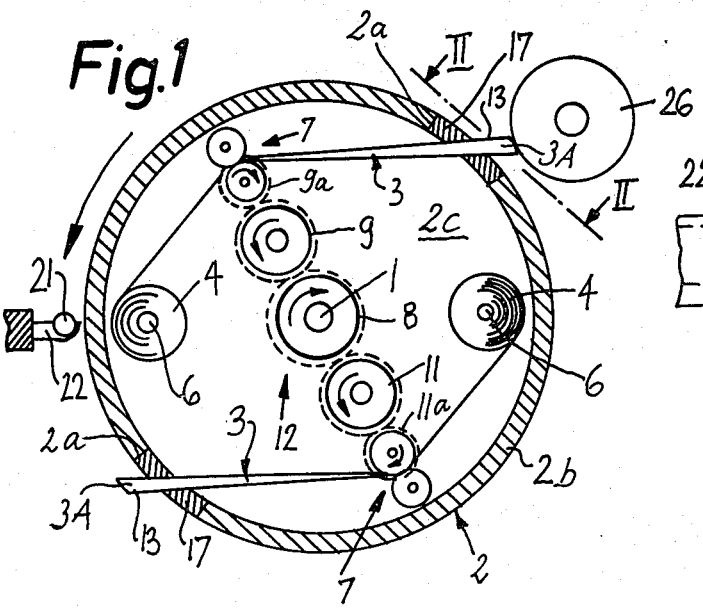
FIG. 1 is a transverse sectional view of a severing apparatus which embodies one form of the invention and comprises two band-like knives.

The severing apparatus or cutoff which is shown in FIG. 1 comprises a hollow cylindrical housing or carrier 2 which is rotated about the axis of a shaft 1 mounted in the frame or housing (not shown) of a cigarette rod making or filter rod making machine. The internal space or compartment 2*c* of the carrier 3 contains two shafts 6 which are parallel to the shaft 1 and are disposed diametrically opposite each other with reference to the axis of the carrier 2. Each of the shafts 6 supports a discrete reel 4 consisting of a convoluted metallic strip or band material constituting an elongated flexible knife 3 having a cutting edge 13 which extends longitudinally thereof and constitutes one marginal portion of the band material. The reels 4 are rotatable on or with the respective shafts 6 and each of the knives 3 is advanced, either continuously or at desired intervals, by pairs of advancing rolls 7. As shown in FIG. 1, the knives 3 advance through the nips of the respective pairs of advancing rolls 7 and toward and through suitable openings or cutouts 2*a* which are provided in the cylindrical wall 2*b* of the carrier 2. Each such opening accommodates an adjustably mounted disc-shaped chuck 17 having a transverse guide slot 14 for the leader 3A of the respective knife 3 and being releasably held in the carrier wall 2*b* by a pair of screws 16 or analogous detent means so as to change the orientation of the leading end of the respective knife.

The means for feeding the knives 3 in directions to draw the flexible band material off the respective reels 4 comprises a planetary transmission 12 which can be operated by hand or automatically in response to rotation of the carrier 2 (e.g., by way of a suitable geneva movement or an analogous device which can impart intermittent movements to the rotary components of the transmission). The transmission 12 comprises a sun gear 8 which is coaxial with the shaft 1 and transmits motion to planet pinions 9 and 11 respectively meshing with gears 9*a*, 11*a* the adjacent advancing rolls 7.

Figure 2:
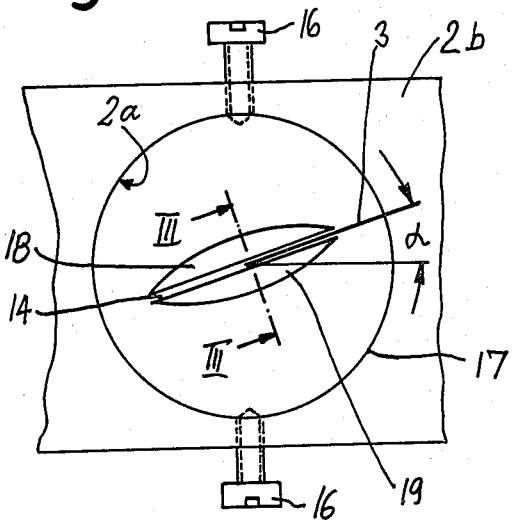
FIG. 2 is an enlarged fragmentary sectional view as seen in the direction of arrows from the line II—II of FIG. 1.
Figure 4:
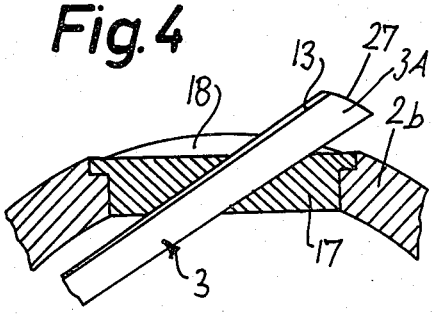
FIG. 4 is an enlarged sectional view of a detail in the severing apparatus of FIG. 1.

The angle of attack alpha (see FIG. 2) denotes the orientation of the leader 3A of the respective knife 3 with reference to the axis of the shaft 1 as well as with reference to the axis of the continuous cigarette rod 21 which is advanced axially at right angles to the plane of FIG. 1 and is guided by a tubular member 22 serving to support that portion of the rod 21 which is located at the severing station. The tubular guide member 22 moves forwardly with the rod 21 while the leader 3A of one of the knives 3 performs a severing action. The guide 22 is thereupon retracted and advances again while the leader 3A of the other knife 3 severs the rod 21. The magnitude of the angle alpha is variable by releasing the detent screws 16 and by thereupon changing the angular positions of the chucks 17 with reference to the cylindrical wall 2*b* of the carrier 2.

Figure 3:
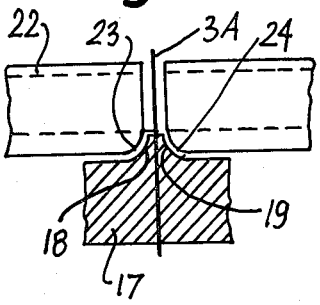
FIG. 3 is a fragmentary sectional view as seen in the direction of arrows from the line III—III of FIG. 2.

In order to enhance the stability of the leaders 3A of the knives 3, the chucks 17 are preferably provided with stiffening protuberances or cheeks 18, 19 which flank the respective slots 14 and define relatively narrow but wide passages for the respective portions of the knives. Satisfactory stability of the knives 3 is desirable in order to ensure that the leaders 3A of the knives will not yield and thereby leave their predetermined paths in the course of the actual severing operation, i.e., while their cutting edges pass through the wrapper and the filler of the axially conveyed rod 21. The cheeks 18, 19 extend outwardly from the carrier 2, i.e., they are disposed at the outer sides of the respective chucks 17. As shown in FIG. 3, the tubular guide member 22 for the rod 21 has sockets or recesses 23, 24 for the cheeks 18, 19 of the chucks 17; this ensures that the leader 3A of each of the knives 3 is confined between the respective cheeks all the way to the locus where the cutting edges 13 actually sever the rod 21. The outlines of surfaces bounding the sockets 23, 24 are complementary to the outlines of the respective cheeks 18 and 19.

The carrier 2 moves the knives 3 past a driven grinding wheel 26 which serves to remove the tip of the leader 3A of the adjacent knife 3 at least at such time when the knives 3 are advanced by the planetary transmission 12. Thus, the grinding wheel 26 is not needed to sharpen the cutting edges 13 but rather to reduce the outermost portions or tips of the knives 3 at the same rate at which the knives 3 are fed, i.e., at the same rate at which the material of the knives is paid out by the respective reels. The front edge faces 27 which are treated by the working surface of the grinding wheel 26 are not the cutting edges of the respective knives. The cutting edges 13 become dull in response to repeated severing of the rod 21 and, once those portions of the cutting edges 13 which are in the endless path that is traversed by the rod 21 become sufficiently worn, the transmission 12 advances the knives 3 by a requisite increment so as to place fresh portions of cutting edges 13 into severing positions while the grinding wheel 26 removes corresponding lengths of the material of the knives at the respective front edge faces 27.

Figure 5:
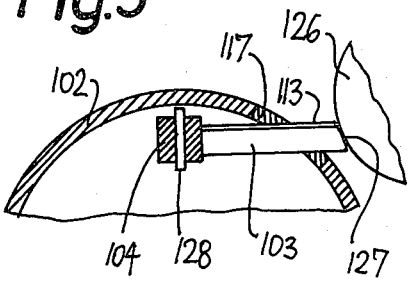
FIG. 5 is a fragmentary transverse sectional view of a second severing apparatus.

FIG. 5 illustrates a modified severing apparatus wherein all such parts which are identical with or clearly analogous to corresponding parts of the apparatus of FIG. 1 are denoted by similar reference characters plus 100. The difference between the two apparatus is that the reels 104 (only one shown in FIG. 5) are mounted for rotation about or with shafts 128 which are normal to the axis of rotation of the carrier 102. This means that there is no need to twist the knives 103 between the respective reels 104 and the associated chucks 117. The advancing rolls and the means for rotating the advancing rolls so as to feed the knives 103 toward the grinding wheel 126 are not shown in FIG. 5. In fact, the portions of knives 103 between the respective reels 104 and the chucks 117 can remain flat.

The improved cutoff is susceptible of many further modifications without departing from the spirit of the invention. For example, the apparatus can comprise one, three or more band-like flexible knives and the metallic bands whidh constitute the knives 3 and 103 can be designed to sever the rod at their ends, i.e., in the regions of their edge faces 27 and 127. The grinding tool 26 or 126 is then designed to sharpen such cutting edges or edge faces, and the length of the knives is maintained at a constant value as a result of feeding of the knives as well as in response to removal of material on repeated severing of the rod. The sharpening means for the cutting edge at the front end face of the leader of each knife could be constructed and assembled in a manner as disclosed, for example, in U.S. Pat. No. 3,258,881 granted July 5, 1966 to Mason et al., U.S. Pat. No. 3,328,923 granted July 4, 1967 to Mason et al. or U.S. Pat. No. 3,604,162 granted September 14, 1971 to Preston et al. It has been found that such mode of utilizing a band-like knife is less satisfactory than the embodiments which are illustrated in the drawing, namely, wherein one longitudinally extending marginal portion 13 or 113 of each band-like knife constitutes a cutting edge. First of all, there is no need to sharpen the cutting edge while the apparatus is in use; all that is needed is to feed the knife at regular or irregular intervals so as to move a fresh portion or part of the cutting edge 13 or 113 to an optimum position for severing of the rod and to simultaneously reduce the length of the knife (or, more accurately stated, of the leader of the knife) to the extent to which the planetary transmission rotates the convoluted portions of the knives. Proper synchronizing of feeding action with sharpening action is quite difficult when the carrier is driven at a very high speed so as to subdivide the rod at the rate which is needed to produce in excess of 100 discrete rod-shaped articles per second. At such high RPM of the carrier (which may rotate about one or more axes, for example, for reasons which are disclosed in commonly owned U.S. Pat. No. 3,518,911 granted July 7, 1970 to Niemann et al.), complex kinematic problems which arise in connection with proper control of positioning of the severing portions of knives, especially since the planes of the knives are normally inclined with reference to the axis of the rod and/or the axis of the rotating carrier, cannot be readily controlled when the cutting edge is the front edge face of the knife. Moreover, such mode of operation necessitates appropriate mounting of the sharpening tool and appropriate configuration of the working surface of the sharpening tool. All this can be avoided by the simple expedient of utilizing one longitudinally extending marginal portion of each knife as a cutting edge which need not be sharpened at all but is merely shifted lengthwise whenever the need arises in order to ensure the making of clean cuts.

The angle at which the leader of each knife extends from the associated chuck depends on the desired format of the finished products. Adjustability of each chuck with reference to the carrier 2 or 102 allows for rapid and accurate selection of different formats.

An important advantage of the improved apparatus is that the carrier 2 or 102 can accommodate relatively large convoluted portions or reels of band-like metallic material of the knives so that the useful life of each knife is incomparably longer than the useful life of heretofore known knives. Moreover, each convoluted portion or reel can be readily inserted into or removed from the carrier with little loss in time. Furthermore, the quality of the grinding action is not as critical as in conventional apparatus since the grinding tool merely serves to shorten the band-like material but is not required to sharpen the cutting edge or edges. Such mode of utilizing the grinding tool renders it possible to employ relatively simple severing and grinding instrumentalities.

The manner in which the tubular guide member 22 is movable with the rod during severing by the knives is well known; for example, such reciprocable tubular guide members are used in the aforediscussed commercially available filter rod making and cigarette rod making machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing an axially conveyed rod which contains a filler of fibrous material of the like into diecrete rod-like sections, comprising a hollow carrier rotatable about at least one predetermined axis; an elongated flexible band-like knife including a convoluted portion installed in the interior of and supported by said carrier and a leader extending from said convoluted portion, said carrier having an opening through which the leader of said knife extends outwardly and said leader being arranged to sever the rod in response to rotation of said carrier, said knife having an elongated marginal portion which constitutes a cutting edge and that part of said cutting edge which is provided on said leader being arranged to sever the rod in response to rotation of said carrier; feeding means for rotating said convoluted portion in a direction to unwind the knife and to thereby advance fresh parts of said cutting edge through and beyond said opening; and means for removing material from said leader at the rate at which said feeding means rotates said convoluted portion.

2. The apparatus of claim 1, further comprising means for removably mounting said convoluted portion of said knife in said carrier.

3. The apparatus of claim 1, wherein said material removing means comprises a rotary grinding tool and said leader has a front edge face engaging said tool.

4. The apparatus of claim 1, wherein said convoluted portion constitutes a reel having an axis which is substantially parallel to said predetermined axis.

5. The apparatus of claim 1, wherein said convoluted portion constitutes a reel having an axis which is inclined with reference to said predetermined axis.

6. The apparatus of claim 1, wherein said knife is a metallic band of constant width.

7. The apparatus of claim 1, wherein said feeding means comprises a planetary transmission.

8. The apparatus of claim 1, further comprising a second elongated flexible knife including a convoluted portion supported by said carrier and a leader extending from said last named convoluted portion, said last named leader being arranged to sever the rod alternately with said first named leader in response to rotation of said carrier.

9. Apparatus for subdividing an axially conveyed rod which contains a filler of fibrous material of the like into discrete rod-like sections, comprising a carrier rotatable about at least one predetermined axis; an elongated flexible band-like knife including a convoluted portion installed in the interior of and supported by said carrier and a leader extending from said convoluted portion, said carrier having an opening through which the leader of said knife extends outwardly and said leader being arranged to sever the rod in response to rotation of said carrier; a chuck installed in said opening and having a slot through which the leader extends from said carrier, said chuck being rotatable with reference to said carrier about an axis which is inclined with reference to said predetermined axis; and detent means for releasably holding said chuck in a selected position of adjustment with reference to said carrier.

10. Apparatus for subdividing an axially conveyed rod which contains a filler of fibrous material or the like into discrete rod-like sections, comprising a hollow carrier rotatable about at least one predetermined axis; an elongated flexible band-like knife including a convoluted portion installed in the interior of and supported by said carrier and a leader extending from said convoluted portion, said carrier having an opening through which the leader of said knife extends outwardly and said leader being arranged to sever the rod in response to rotation of said carrier; and a chuck installed in said opening and having a slot through which said leader extends from said carrier, said chuck including two cheeks flanking said slot at that side of said chuck which faces away from the interior of said carrier.

11. The apparatus of claim 10, wherein said knife is at least slightly twisted between said slot and said convoluted portion.

12. Apparatus for subdividing an axially conveyed rod which contains a filler of fibrous material or the like into discrete rod-like sections, comprising a carrier rotatable about at least one predetermined axis; and an elongated flexible bank-like knife including a convoluted portion supported by said carrier and a leader extending from said conoluted portion, said convoluted portion constituting a reel having an axis which is inclined with reference to said predetermined axis and said leader being arranged to sever the rod in response to rotation of said carrier.

13. The apparatus of claim 1, wherein said carrier is hollow and said convoluted portion is installed in the interior of said carrier, said carrier having an opening through which the leader of said knife extends outwardly.

14. The apparatus of claim 13, wherein said knife has an elongated marginal portion which constitutes a cutting edge, that part of said cutting edge which is provided on said leader being arranged to sever the rod in response to rotation of said carrier.

15. The apparatus of claim 14, further comprising feeding means for rotating said convoluted portion in a direction to unwind the knife and to thereby advance fresh parts of said cutting edge through and beyond said opening.

16. The apparatus of claim 15, further comprising means for removing material from said leader at the rate at which said feeding means rotates said convoluted portion.

17. The apparatus of claim 13, further comprising a chuck installed in said opening and having a slot through which said leader extends from said carrier.

18. The apparatus of claim 17, wherein said chuck is adjustable with reference to said carrier and further comprising detent means for releasably holding said chuck in a selected position of adjustment with reference to said carrier.

19. The apparatus of claim 17, wherein said chuck has at least one cheek at one side of said leader.

20. The apparatus of claim 12, wherein the axis of said reel is substantially normal to said predetermined axis.

* * * * *